US005371437A

United States Patent [19]

Amano

[11] Patent Number: 5,371,437

[45] Date of Patent: Dec. 6, 1994

[54] DISCHARGE TUBE FOR DISPLAY DEVICE

[75] Inventor: Yoshifumi Amano, Tokyo, Japan

[73] Assignee: Technology Trade And Transfer Corporation, Kamakura, Japan

[21] Appl. No.: 979,631

[22] Filed: Nov. 20, 1992

[30] Foreign Application Priority Data

| | | | |
|---|---|---|---|
| Nov. 29, 1991 | [JP] | Japan | 3-356127 |
| Feb. 27, 1992 | [JP] | Japan | 4-090402 |
| Mar. 30, 1992 | [JP] | Japan | 4-074603 |

[51] Int. Cl.[5] ..... G09G 3/10

[52] U.S. Cl. ..... 315/169.1; 315/169.4; 313/584; 313/586; 313/590

[58] Field of Search ..... 315/169.1, 169.4; 313/584, 586, 590; 340/776, 777, 778

[56] References Cited

U.S. PATENT DOCUMENTS

| | | | |
|---|---|---|---|
| 4,866,349 | 9/1989 | Weber et al. | 315/169.1 X |
| 4,999,541 | 3/1991 | Kim et al. | 313/584 |
| 5,138,225 | 8/1992 | Kim | 313/584 |
| 5,153,483 | 10/1992 | Kishino et al. | 315/169.1 X |

*Primary Examiner*—Benny Lee

*Assistant Examiner*—Haissa Philogene

*Attorney, Agent, or Firm*—Bauer & Schaffer

[57] ABSTRACT

The present invention is directed to a discharge tube for use with a display device which is simple in structure and which can be mass-produced satisfactorily. Further, the discharge tube for display device of the present invention can be increased in resolution and can be made large in size with ease. Furthermore, the discharge tube for use with a display device of the present invention can be made inexpensive with ease. A pair of memory elements (Ma), (Mb) having memory electrodes (3*a*), (3*b*) formed of conductive layers having a plurality of apertures (5*a*), (5*b*) arranged in an XY matrix form and in which the whole surface of the memory electrodes (3*a*), (3*b*) are covered with insulating layers (4*a*), (4*b*) are laminated such that corresponding apertures (5*a*), (5*b*) covered with the insulating layers (4*a*), (4*b*) are communicated with each other to thereby form discharge cells. all of which are sealed into a tube body in which a discharging gas is sealed. Then, an AC voltage necessary for maintaining a discharge is applied between the memory electrodes (3*a*), (3*b*) of the pair of memory elements (Ma), (Mb).

7 Claims, 19 Drawing Sheets

DISCHARGE TUBE FOR DISPLAY DEVICE

BACKGROUND OF THE INVENTION

1. Field of the Invention

The present invention generally relates to discharge tubes and, more particularly, is directed to a discharge tube for use with display devices.

2. Description of the Prior Art

Conventional discharge tubes for use with display devices will be described hereinafter with reference to FIGS. 1 to 3.

FIG. 1 of the accompanying drawings shows a conventional DC -plasma display panel (PDP). As shown in FIG. 1, a plurality of parallel striped cathodes 7 are deposited on a rear glass panel 6 according to a thick film technique such as a screen printing or the like. On a front glass panel 1 that constructs a tube together with the rear glass panel 6, there are deposited a plurality of parallel striped transparent anodes (made of ITO (indium tin oxide)) 2 at a right angle with respect to the cathodes 7. Barrier ribs 12 that prevent discharge from being spread are deposited on the front glass panel 1 or on the rear glass panel 6 so as to be located at each spacing between the adjacent anodes 2 according to the thick film technique. A discharging gas is sealed into the tube composed of the front glass panel 1 and the rear glass panel 6.

FIG. 2 of the accompanying drawings shows a conventional AC-PDP. As shown in FIG. 2, a plurality of parallel striped Y electrodes 14 are deposited on the rear glass panel 6 according to a thick film technique such as screen printing and so on or a thin film technique such as vapor deposition, etching or the like. On the front glass panel 1 that constructs a tube together with the rear glass panel 6, there are deposited a plurality of parallel striped X electrodes 13 at a right angle with respect to the Y electrodes 14 according to the thick film technique such as screen printing and so on or the thin film technique such as vapor deposition, etching or the like. The plurality of Y electrodes 14 and the plurality of X electrodes 13 are respectively covered with insulating layers **15*b*, 15*a* and protecting layers 16*b*, 16*a* are deposited on the insulating layers 15*b*, 15*a***, respectively. The AC type PDP does not need barrier ribs because the discharge is difficult to be diffused.

FIG. 3 of the accompanying drawings shows a conventional hybrid-PDP (see Japanese Published Patent Publication No. 376468). As shown in FIG. 3, a plurality of address electrodes 22, 23, each having a self-scanned function based on the DC discharge, are formed on the rear glass panel 6 to be intersected at a right angle one another. A semi-AC memory unit comprises a transparent full electrode 17 disposed on the front glass plate 1. and which establishes discharge spaces between it and the address electrodes 22, 23 of the rear glass panel 6 through a plurality of apertures and a plurality of aperture metal electrode plate 20 having apertures which are opposed to the transparent full electrode 17. Insulating substrates 24 are disposed on each spacing between the adjacent address electrodes 22, and the transparent full electrode 17 is covered with a transparent insulating layer 18. Barriers 19, 21 are respectively disposed between the aperture metal electrode plate 20 and the transparent insulating layer 18 and between the aperture metal electrode plate 20 and the insulating substrate 24. The above elements thus arranged are sealed into a tube formed of the rear glass panel 6 and the front glass panel 1 and containing therein discharge gas.

According to this hybrid-PDP, the electron, generated due to discharge between the address electrodes 22, 23, is supplied to the semi-AC memory unit side by a voltage applied to the aperture metal electrode plate 20 so that AC-discharge is maintained between the transparent full electrode 17 covered with the transparent insulating layer 18 on the front glass panel 1 and the aperture metal electrode plate 20. The hybrid-PDP could simplify a circuit owing to the self-scanned function thereof and increase a brightness owing to the memory function thereof.

The conventional DC-PDP shown in FIG. 1 is simple in structure and is driven to display an image by simultaneously applying a signal to the plurality of anodes 2 and also by sequentially applying a ground potential to the plurality of cathodes 7 in a so-called line sequential driving fashion. Therefore, the driving of the DC-PDP can be simplified. However, the above DC-PDP has no memory function so that, if the number of the anodes 2 and the cathodes 7 is increased in order to increase a resolution, then a luminous brightness is lowered. Moreover, the electrodes are short in service life because a sputtering phenomenon occurs on the electrodes due to the direct ion bombardment, The conventional AC-PDP shown in FIG. 2 has a memory function based on wall charge caused by the fact that electric charges are accumulated in the insulating layers that cover the electrodes so that, even if the number of X electrodes and Y electrodes is increased in order to increase a resolution, then a brightness can be prevented from being lowered. On the other hand, a complex signal must be applied between the X and Y electrodes in order to write, memorize and erase a signal. Consequently, a driving circuit for the AC-PDP becomes complicated and a manufacturing process for PDP also becomes complicated because the operation range must be widened.

The conventional hybrid-PDP shown in FIG. 3 is apparently complicated in structure and hence cannot be mass-produced. Moreover, this hybrid-PDP suffers from the following shortcomings and disadvantages.

The diameter of aperture through which the discharge spaces of the address electrode side and the memory unit side are coupled must be increased to make the coupling between the two discharge spaces strong so that the hybrid-PDP can be operated reliably. If the diameter of aperture is increased too much, then it is contradictory that the two discharge spaces cannot be separated reliably. When the memory discharge is erased, the wall electric charge accumulated on the insulating layer formed on the transparent electrode of the front glass panel must be erased. In this case, if the diameter of the aperture on the metal electrode plate is small, then it becomes impossible to control the wall electric charge by the address electrode on the rear glass panel side. Further, if the diameter of the above aperture is large, then the stable addressing and the self-scanned function are deteriorated by influences of memory discharge. Furthermore, the aperture metal electrode plate that isolates the address side and the display side of the display panel must be exposed to the gas in order to extract the electrons from the addressing discharge at the scanning section even though a part of the metal electrode plate is covered with the insulating layer or the metal layer is formed on an insulating body instead of the metal plate. Accordingly, due to the insulation of the aperture metal electrode plate from the DC-scanning section and the safe operation, the elements must be separated with high accuracy one another from a structure standpoint, which makes the manufacturing process of the hybrid-PDP more difficult. In addition, since the above hybrid-PDP operates in a semi-AC fashion, the wall electric charge that contributes to the memory function is accumulated only in the address side. Therefore, the memory function is not powerful and the hybrid-PDP needs a high voltage to maintain the memory function.

OBJECTS AND SUMMARY OF THE INVENTION

Therefore, it is an object of the present invention to provide an improved discharge tube for use with a display device in which the aforesaid shortcomings and disadvantages encountered with the prior art can be eliminated.

More specifically, it is an object of the present invention to provide a discharge tube for use with a display device which is simple in structure.

Another object of the present invention is to provide a discharge tube for use with a display device which can be mass-produced satisfactorily.

Still another object of the present invention is to provide a discharge tube for use with a display device which can increase a resolution.

A further object of the present invention is to provide a discharge tube for use with a display device which can be made large in size.

Yet a further object of the present invention is to provide a discharge tube for use with a display device which can be driven with ease.

Yet a further object of the present invention is to provide a discharge tube for use with a display device in which a driving circuit thereof can be simplified in structure.

Still a further object of the present invention is to provide a discharge tube for use with a display device which can be made inexpensive.

According to a first aspect of the present invention, there is provided a discharge tube for display which comprises a pair of memory elements, each including a memory electrode formed of a conductive layer having a plurality of apertures arranged in an XY matrix form and in which the whole surface of the memory electrode is covered with an insulating layer, the pair of memory elements being laminated each other such that corresponding apertures covered with the insulating layers are communicated with each other to form discharge cells, and a tube body into which the pair of memory elements are sealed and into which a discharging gas is sealed, wherein an AC voltage necessary for maintaining a discharge is applied between the memory electrodes of the pair of memory elements.

According to a second aspect of the present invention, there is provided a discharge tube for display which comprises a pair of memory elements, each including a memory electrode formed of a conductive layer having a plurality of apertures arranged in an XY matrix form, and in which the whole surface of the memory electrode is covered with an insulating layer, the pair of memory elements being laminated each other such that corresponding apertures covered with the insulating layers are communicated with each other to form discharge cells, a plurality of parallel striped first and second address electrodes being disposed at a predetermined interval so as to cross each other, the pair of memory elements laminated each other being disposed between the plurality of first and second address electrodes such that respective crossing points of the first and second address electrodes correspond to the respective discharge cells, and a tube body into which the first and second address electrodes and the pair of memory elements are sealed and into which a discharging gas is sealed, wherein a predetermined voltage is applied between the first and second address electrodes selected from the plurality of first and second address electrodes to cause a discharge to occur in the discharge cell located at the crossing point thereof and a predetermined AC voltage is applied between the pair of memory electrodes to thereby maintain the discharge.

In accordance with a third aspect of the present invention, there is provided a discharge tube for display which comprises a front side memory element including a front side memory electrode having a plurality of apertures arranged in an XY matrix form serving as discharge cells, the whole surface of the front side memory electrode being covered with an insulating layer, a rear side memory element the whole surface of which is formed of a conductive layer and the whole surface of which is covered with an insulating layer, the front side memory element and the rear side memory element being disposed in an opposing relation, a plurality of parallel striped first and second address electrodes being disposed so as to cross each other, the front side memory element being disposed between the plurality of first and second address electrodes such that respective crossing points of the first and second address electrodes correspond to respective discharge cells, and a tube body into which a discharging gas is sealed and into which the plurality of second address electrodes are sealed such that they are disposed between the front side and rear side memory elements, wherein a predetermined voltage is applied between the first and second address electrodes selected from the plurality of first and second address electrodes to cause a discharge to occur in the discharge cell located at the crossing point of the first and second address electrodes, and a predetermined AC voltage is applied between the front side and rear side memory electrodes to thereby maintain the discharge.

In accordance with a fourth aspect of the present invention, there is provided a discharge tube for display which comprises a front side memory element including a front side memory electrode the whole surface of which is formed of a transparent conductive layer, the whole surface of the front side memory electrode being covered with a transparent insulating layer, a rear side memory element including a rear side memory electrode the whole surface of which is formed of a conductive layer, the whole surface of the rear side memory electrode being covered with an insulating layer, the front side memory element and the rear side memory element being disposed in an opposing relation, a plurality of parallel striped first and second address electrodes being disposed between the front side and rear side memory elements so as to cross each other, and an insulating barrier having a plurality of apertures serving as discharging cells corresponding to respective crossing points of the first and second address electrodes being disposed therebetween, and a tube body into which a discharging gas is sealed and into which the memory elements, the address electrodes and the insulating barrier are sealed, wherein a predetermined voltage is applied between the first and second address electrodes selected from the plurality of first and second address electrodes to cause a discharge to occur in the discharge cell located at the crossing point of the first and second address electrodes and a predetermined AC voltage is applied between the pair of memory electrodes to thereby maintain the discharge.

In accordance with a fifth aspect of the present invention, there is provided a discharge tube for display which comprises a rear side memory element including a plurality of first and second memory electrodes arranged alternately, the whole surfaces of the plurality of first and second memory electrodes being covered with an insulating layer, a plurality of parallel striped first and second address electrodes being opposed to the rear side memory element so as to cross each other, and an insulating barrier having a plurality of apertures serving as discharge cells corresponding to respective crossing points of the first and second address electrodes being disposed therebetween, and a tube body into which a discharging gas is sealed and into which the rear side memory element, the address electrodes and the insulating barrier are sealed, wherein a predetermined voltage is applied between the first and second address electrodes selected from the plurality of first and second address electrodes to cause a discharge to occur in the discharge cell located at the crossing point of the first and second address electrodes and a predetermined AC voltage is applied between the plurality of first and second of memory electrodes to thereby maintain the discharge.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

Figure 5:
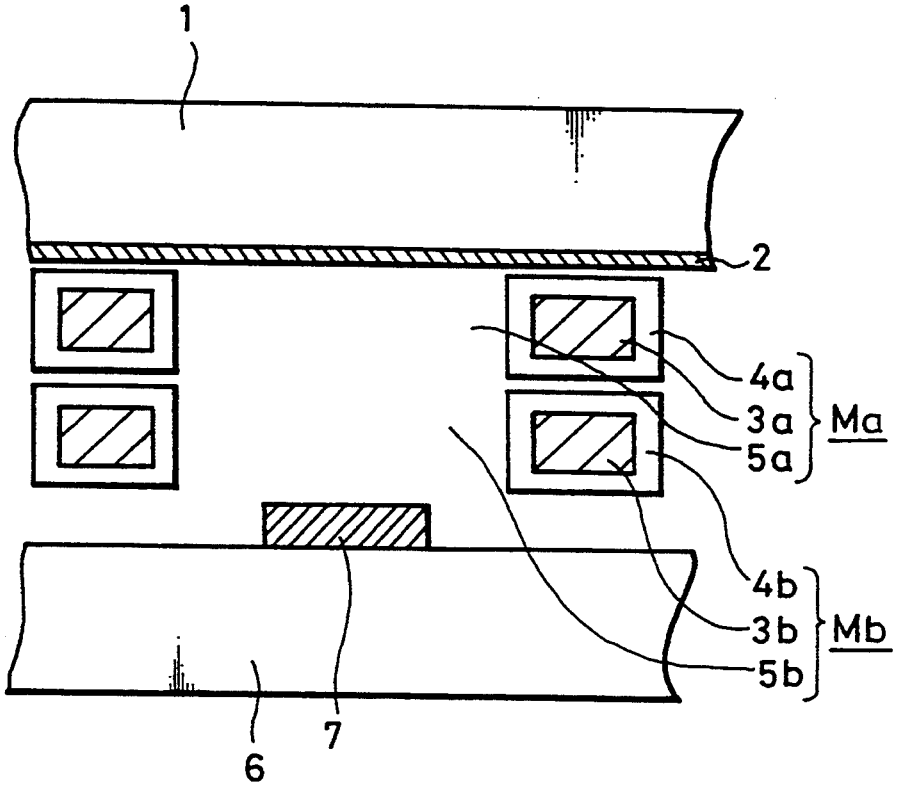
FIG. 5 is a diagrammatic view of a section view showing the first embodiment of the present invention.
Figure 6:
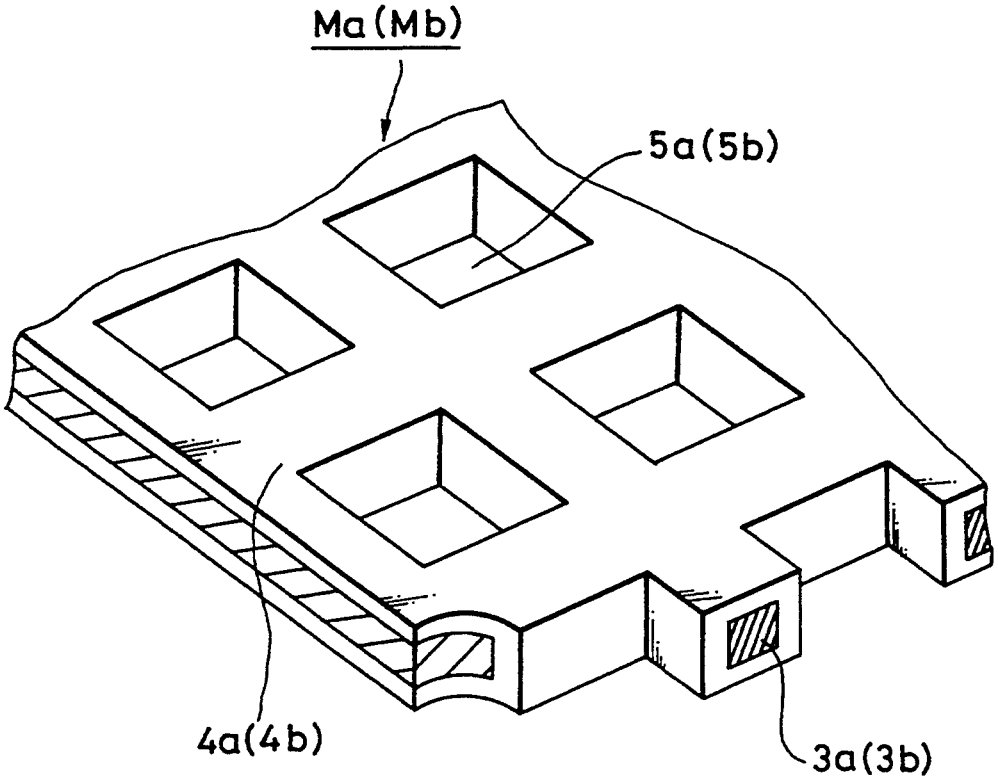
FIG. 6 is a perspective view showing a first example of a memory element used in the first embodiment of the present invention.

Referring to the drawings in detail, and initially to FIGS. 4, 5 and 6, a first embodiment of the present invention will be described in detail hereinafter.

Figure 1:
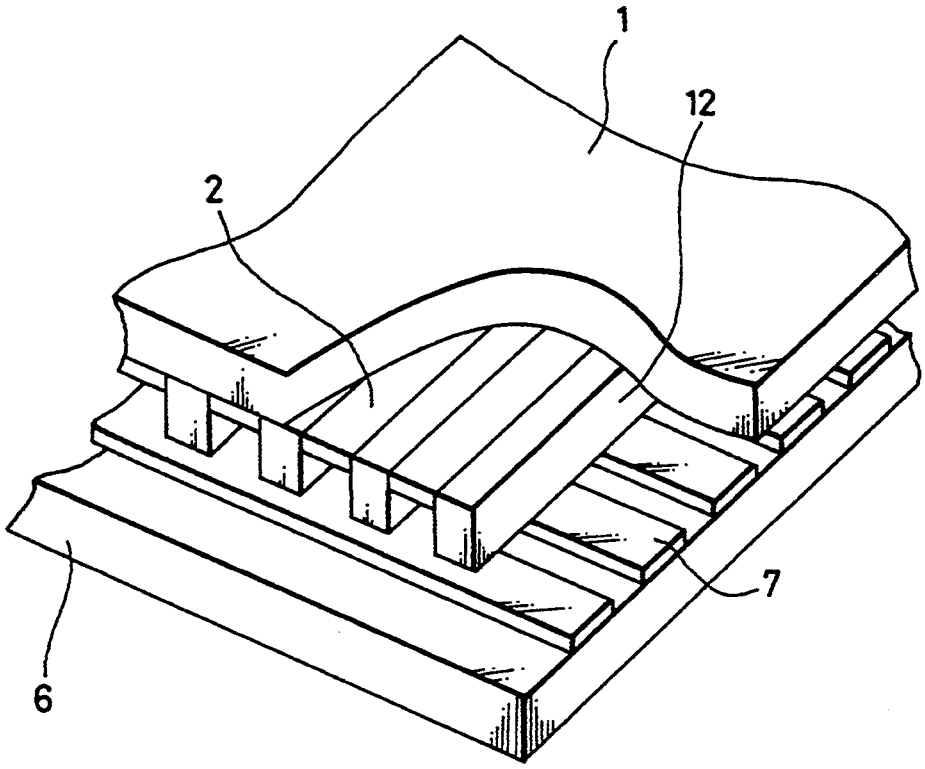
FIG. 1 (PRIOR ART)
FIG. 1 is a perspective view showing an example of a conventional DC type plasma display panel (PDP)
Figure 2:
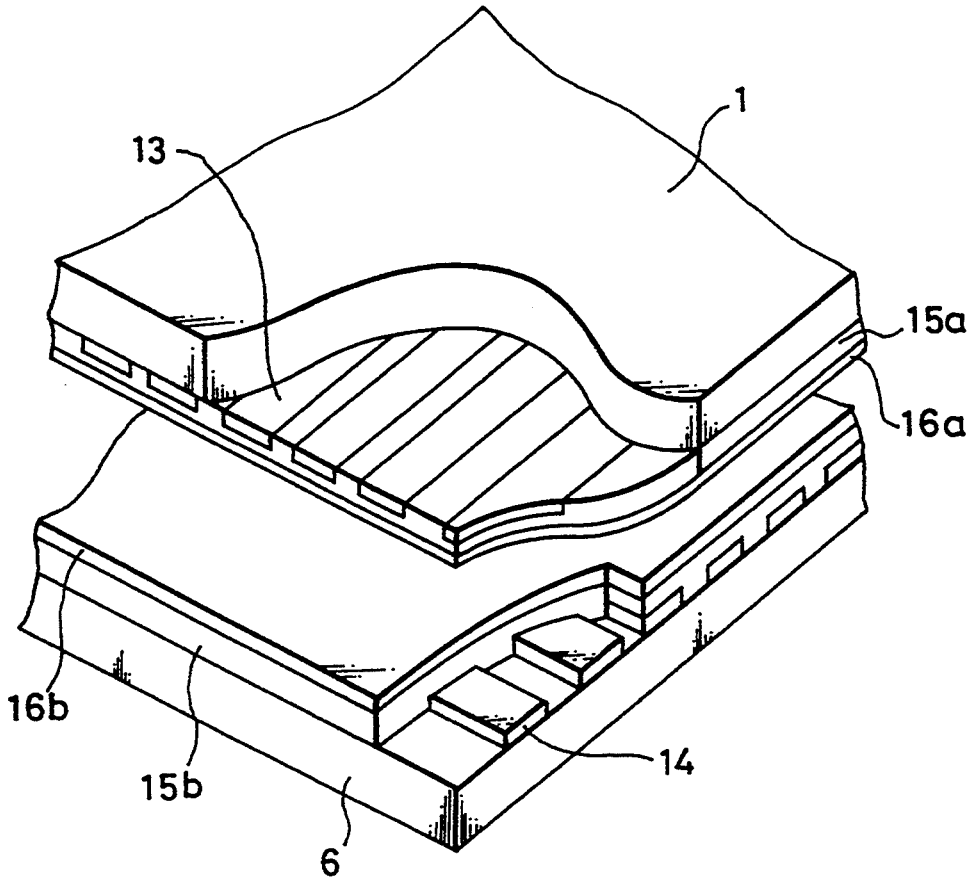
FIG. 2 (PRIOR ART)
FIG. 2 is a perspective view showing an example of a conventional AC-PDP.
Figure 3:
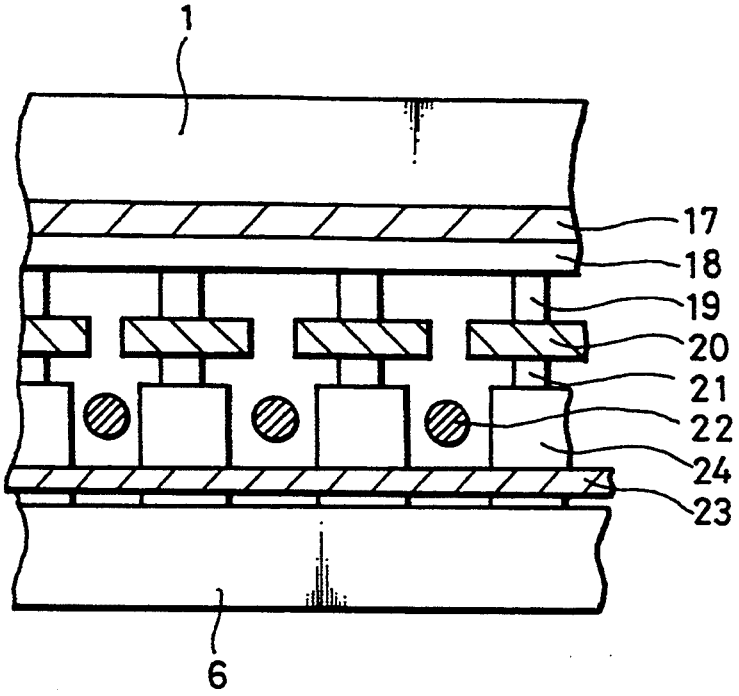
FIG. 3 (PRIOR ART)
FIG. 3 is a diagrammatic view of a section showing an example of a conventional hybrid type PDP.
Figure 4:
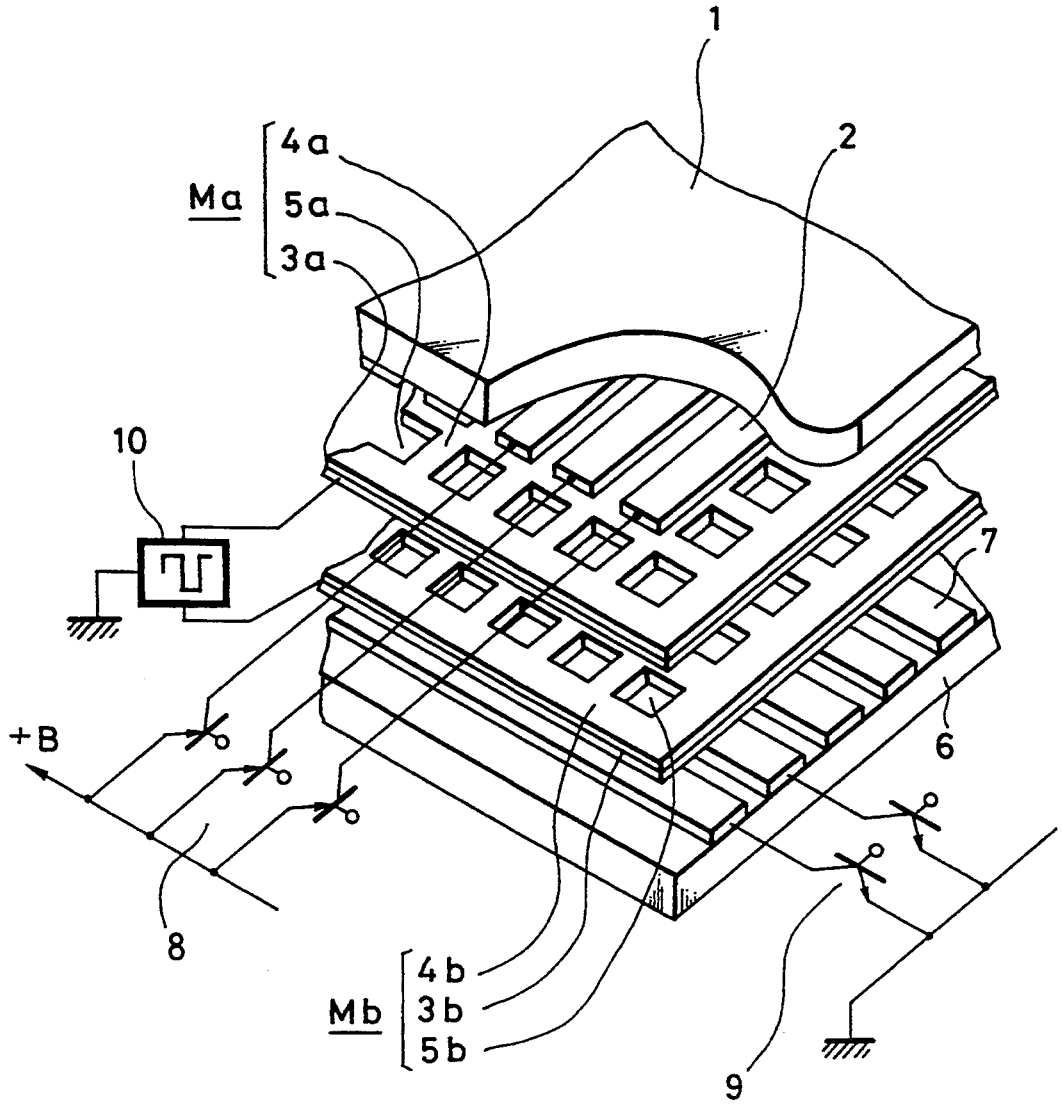
FIG. 4 is an exploded perspective view showing a first embodiment of the discharge tube for use with a display device according to the present invention.

FIG. 4 of the accompanying drawings shows an exploded perspective view of the discharge tube for use with a display device according to the first embodiment of the present invention. FIG. 5 of the accompanying drawings shows a diagrammatic view of a section thereof and FIG. 6 of the accompanying drawings shows a perspective view of a memory element used in the discharge tube according to the first embodiment of the present invention. In FIGS. 4 to 6, like parts identical to those of FIGS. 1 to 3 are marked with the same references and therefore need not be described in detail.

As illustrated, the discharge tube for display includes a tube body. This tube body comprises the front glass panel 1 and the rear glass panel 6 whose peripheral edges are sealed with frit glass and in which the following elements are accommodated. After the tube body was made vacuous, discharge gas such as helium, neon, argon, xenon and so on or mixed gas thereof is sealed into the tube body.

A pair of sheet-like memory elements Ma, Mb respectively include conductive layers having a plurality of square apertures 5*a*, 5*b* arranged in a two-dimensional fashion or in an XY matrix fashion, i.e., memory electrodes 3*a*, 3*b* formed of mesh-shaped metal plates that are formed by the metal plate etching process. The entire surfaces of the memory electrodes 3*a*, 3*b* other than the apertures 5*a*, 5*b* are covered with insulating layers 4*a*, 4*b*, respectively. The shape of the apertures 5*a*, 5*b* is not limited to a square and other shapes such as a circle or the like may be used.

The memory electrodes 3*a*, 3*b* are each made of metal such as stainless steel, aluminum, nickel, etc., or alloy of metals. The insulating layers 4*a*, 4*b* are each formed by sintering at high temperature a paste of glass powder after being coated on the memory electrodes 3*a*, 3*b* according to some suitable process such as spraying, immersion or the like. When the insulating layers 4, 4*b* are made of glass, it is preferable that the memory electrodes 3*a*, 3*b* may have substantially the same thermal expansion coefficient as that of glass. The insulating layers 4*a*, 4*b* may be formed by oxidizing metal or alloy constructing the memory electrodes 3*a*, 3*b*. Furthermore, protecting layers such as magnesium oxide or the like may be formed on the insulating layers 4*a*, 4*b* similarly to the AC-PDP.

The pair of memory elements Ma, Mb of the same shape and size are laminated each other so that the respective corresponding apertures 5*a*, 5*b* covered with the insulating layers 4*a*, 4*b* are communicated to form discharge cells. Then, an AC voltage whose amplitude is sufficient to the extent such that the discharge within the discharge cells can be maintained is applied across the pair of memory electrodes 3*a*, 3*b* from a memory power supply 10.

Memory operation by the pair of memory elements Ma, Mb will be described below.

When a discharge is excited within the discharge cell due to the writing of a signal by the discharge between the anodes 2 and the cathodes 7 which will be described later on, electric charge particles such as ion, electron or the like within the tube body are attracted into the apertures 5*a*, 5*b* in response to the polarity of the memory electrodes 3*a*, 3*b* by the AC voltage applied thereacross and accumulated on the surfaces of the insulating layers 4*a*, 4*b* formed on the inner surfaces of the apertures 5*a*, 5*b* to thereby form a wall electric charge. Then, if the polarity of the memory electrodes 3*a*, 3*b* is inverted by the AC voltage applied thereacross, then a potential difference between the memory electrodes 3*a*, 3*b* is increased because a voltage based on the wall electric charge is superimposed upon the applied AC voltage, resulting in a discharge between the apertures 5*a* and 5*b*. This phenomenon is repeated, whereby a discharge within the discharge cell composed of the apertures 5*a*, 5*b* when the discharge is excited within the discharge cell due to the writing of the signal is maintained.

When the discharge cell is widened, it is enough to laminate three memory elements or more. Apertures of memory elements more than two or three must be made coincident but they are not always the same in shape.

A plurality of parallel striped first and second address electrodes, i.e., the anodes 2 and the cathodes 7 are disposed at a predetermined interval so as to cross each other, i.e., at a right angle. Between the anodes 2 and the cathodes 7, there are located the pair of memory elements Ma, Mb which are laminated such that respective crossing points of the anodes 2 and the cathodes 7 are opposed to respective discharge cells constructed by the respective apertures 5*a*, 5*b*.

Each of the plurality of striped anodes 2 is formed of a transparent conductive layer such as ITO layer or the like. The striped anodes 2 are deposited on the front glass panel 1 with the equal width and at the equal interval. These anodes 2 are commonly connected to a positive voltage source +B through the collectors and emitters of PNP transistors 8 which are supplied at their bases with signals.

The plurality of striped cathodes 7 are deposited on the rear glass panel 6 according to the screen printing and the sintering process of the conductive paste such as nickel or the like. These cathodes 7 are grounded via the collectors and emitters of NPN transistors 9 which are turned on when an operation pulse is sequentially supplied to the bases thereof.

Since it is sufficient that the trigger-like discharge is excited between the anodes 2 and the cathodes 7, either or both of the anodes 2 and the cathodes 7 may be covered an the insulating layer.

The barrier rib is not always needed. If necessary, the barrier rib may be disposed on the front glass panel 1 or on the rear glass panel 6. Alternatively, the barrier rib may be unitarily formed on a part of the insulating layer of the sheet-like memory element.

A means for exciting the discharge within each aperture of the pair of memory elements is not limited to the anodes 2 and the cathodes 7 and other suitable means may be used.

Operation of the above discharge tube for display device will be described with reference to FIGS. 7 to 10.

Figure 7:
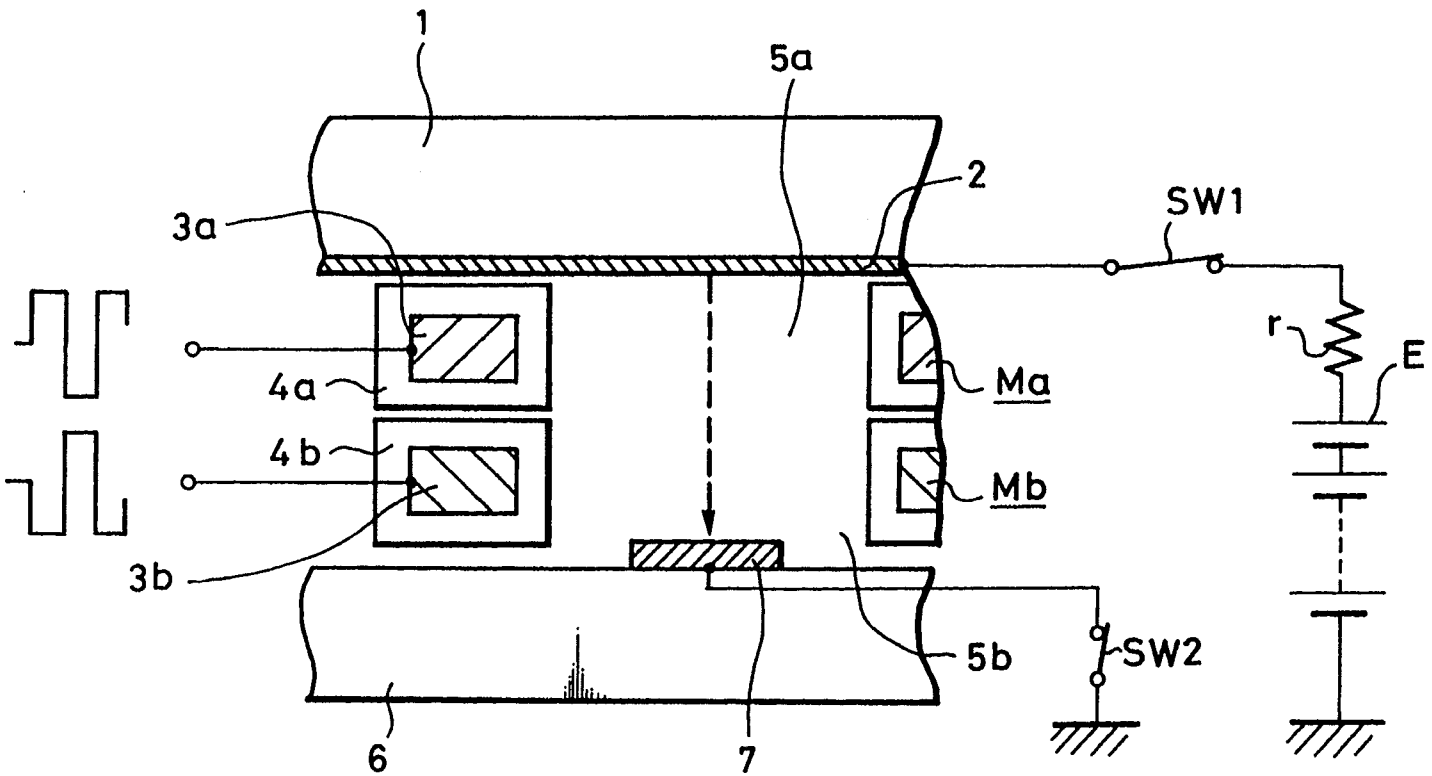
FIG. 7 is a circuit diagram showing a writing operation of the first embodiment of the present invention.
Figure 10:
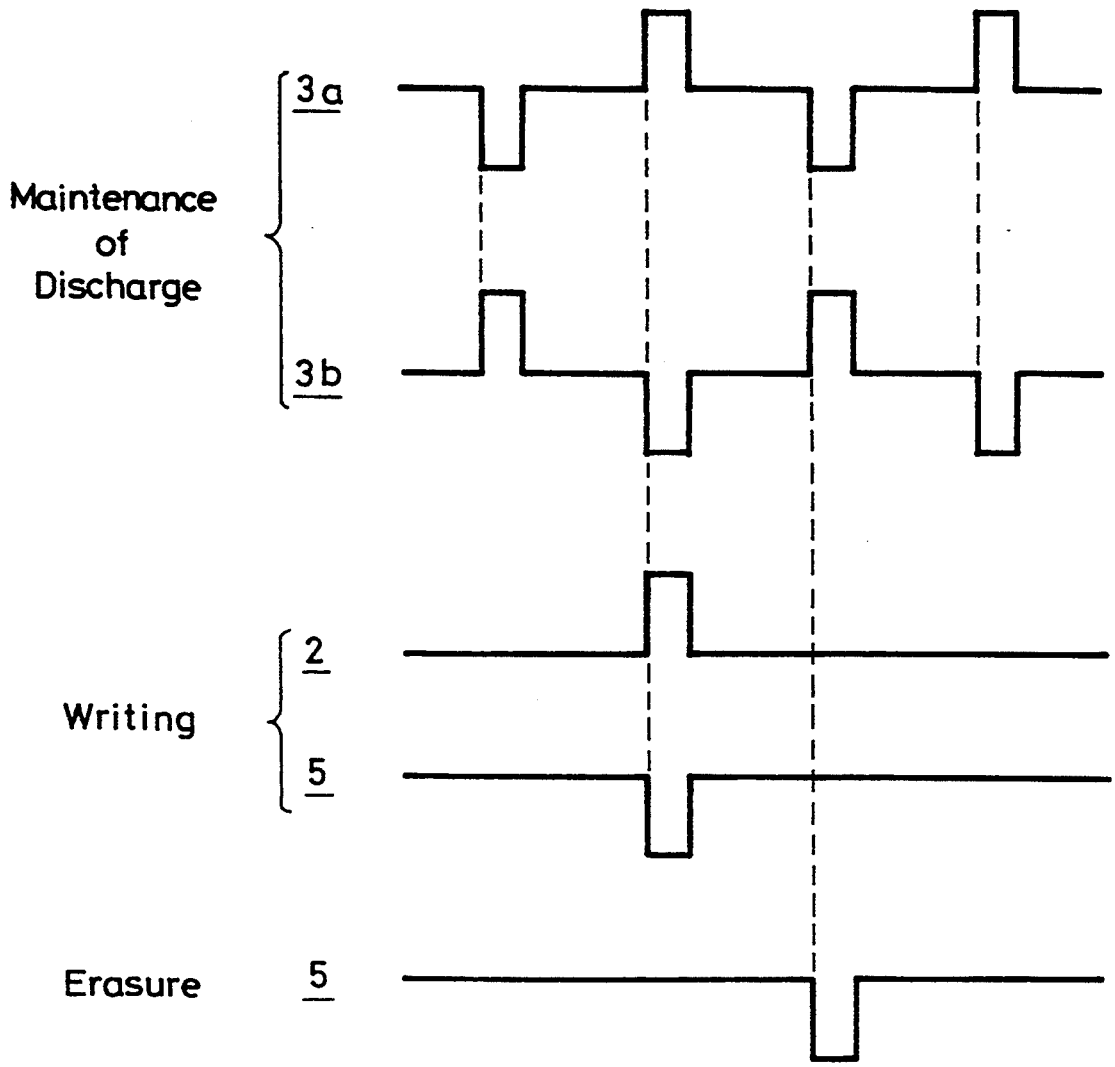
FIG. 10 is a timing chart used to explain operation of the first embodiment of the present invention.

As shown in FIG. 7, when a discharge is not yet excited within the tube body even by the application of pulse voltages of opposite polarity to the pair of memory electrodes 3*a*, 3*b* as shown in FIG. 10 while the AC voltage having an amplitude sufficient to maintain the discharge is applied between the pair of memory electrodes 3*a*, 3*b* and the wall electric charge is not generated within the apertures 5*a*, 5*b* covered with the insulating layers 4*a*, 4*b* of the pair of memory elements Ma, Mb, as shown in FIG. 7, if a switch SW1 is turned on for the first time and a voltage of 200 V to 250 V is applied to the anodes 2 through an internal resistance, then a switch SW2 is turned on and the cathodes 7 are grounded so that a discharge current flows between the anode 2 and the cathode 7.

Figure 8:
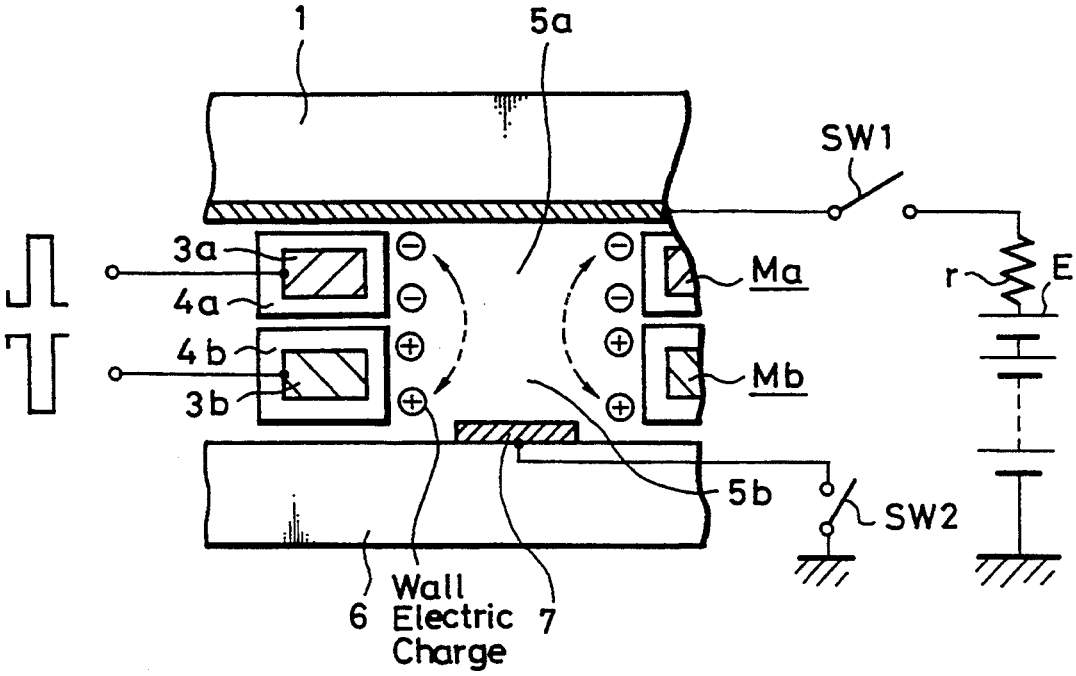
FIG. 8 is a circuit diagram showing a memorizing operation of the first embodiment of the present invention.

Consequently, as shown in FIG. 8, the wall electric charge is generated in the apertures 5*a*, 5*b* covered with the insulating layers 4*a*, 4*b* and the discharge is maintained, thereby a written display being memorized. At that time, the switches SW1, SW2 are both turned off so that a bias voltage, which does not affect the display, is applied to the cathodes 7. Also, the anode 2 is supplied with a voltage that does not affect the discharge of the anode to which other signal is being written.

Figure 9:
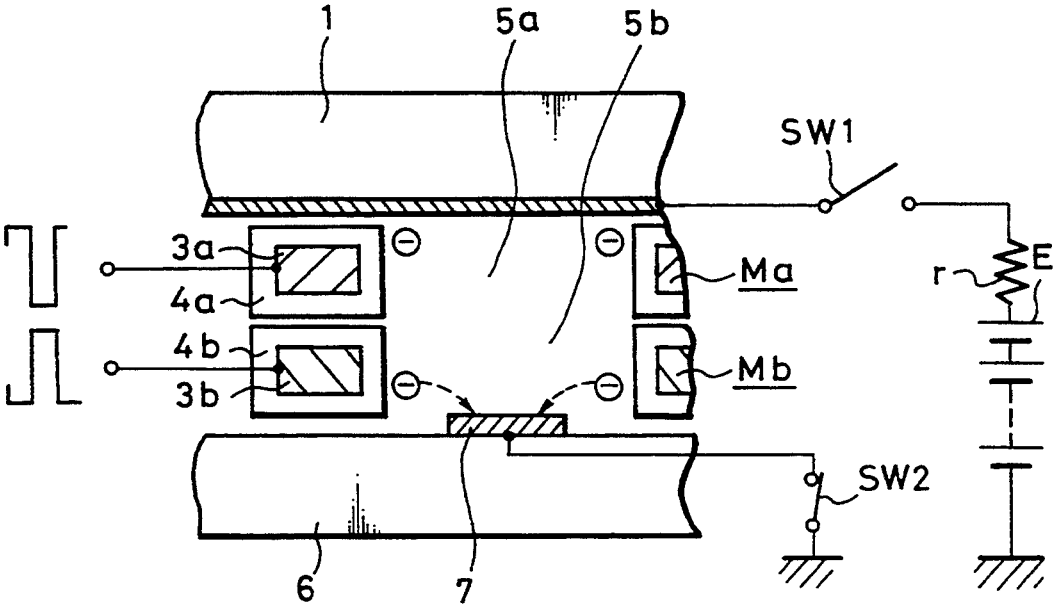
FIG. 9 is a circuit diagram showing an erasing operation of the first embodiment of the present invention.

Operation in which the maintained discharge is stopped, i.e., the memory is erased will be described with reference to FIG. 9. At the timing in which the negative electric charge is accumulated in the aperture 5*b* close to the cathode 7, or when the positive voltage is applied to the memory electrode 3*b*, as shown in FIG. 9, the switch SW2 is turned on to apply a negative erasing pulse to the cathode 7. This negative erasing pulse inhibits the wall electric charge to be accumulated in the inner wall of the aperture 5*b* from being formed. At the next timing, the discharge is therefore stopped and the memory is erased.

Figure 11:
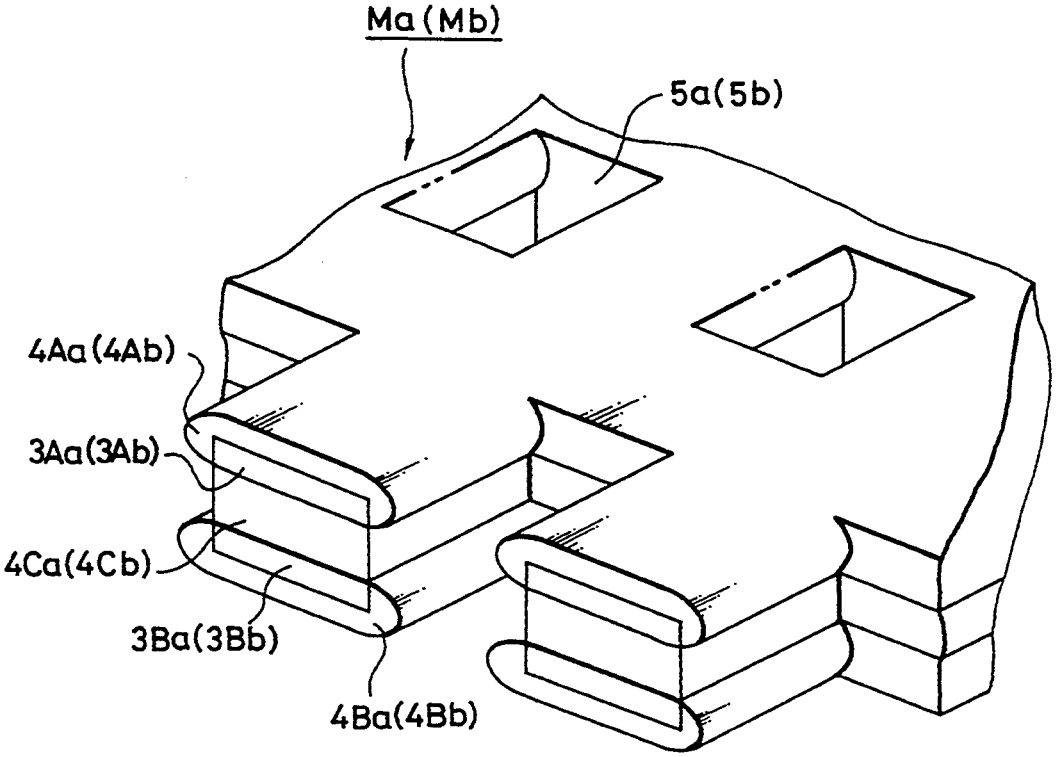
FIG. 11 is a perspective view showing a second example of the memory element used in the first embodiment of the present invention.

Another example of the memory element will be described with reference to FIG. 11. In this example, memory electrodes 3A*a* (3A*b*) and 3B*a* (3B*b*) are deposited on both surfaces of a glass layer 4C*a* (4C*b*) having a plurality of apertures 5*a*, 5*b* arrayed in an XY matrix fashion according to the screen printing process of the metal plate and the following sintering process thereof. Thereafter, insulating layers 4A*a* (4A*b*) and 4B*a* (4B*b*) are deposited on the entire surfaces of the memory electrodes 3A*a* (3A*b*) and 3B*a* (3B*b*) by the spraying process or immersion process of the glass paste, thereby obtaining the memory elements Ma, Mb.

Figure 12:
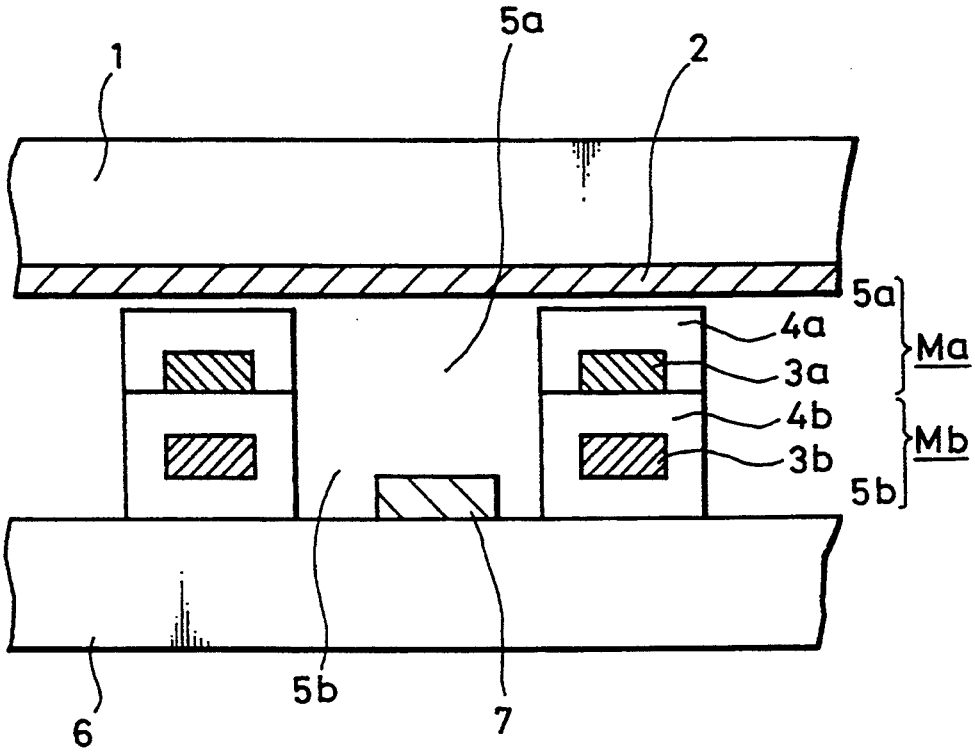
FIG. 12 is a diagrammatic view of a second showing a second embodiment of the present invention.

A second embodiment of the discharge tube for display according to the present invention will be described with reference to FIG. 12. In the second embodiment of the present invention, instead of the sheet-like memory elements Ma, Mb of the first embodiment shown in FIGS. 4 to 6, the memory electrodes 3*a*, 3*b* and the insulating layers 4*a*, 4*b* of the memory elements Ma, Mb are formed together with the anode 2 and the cathode 7 according to the thick film technique. There is then the advantage such that the memory elements Ma, Mb and the anode 2, the cathode 7 can be aligned in relative position easily and accurately.

Figure 13:
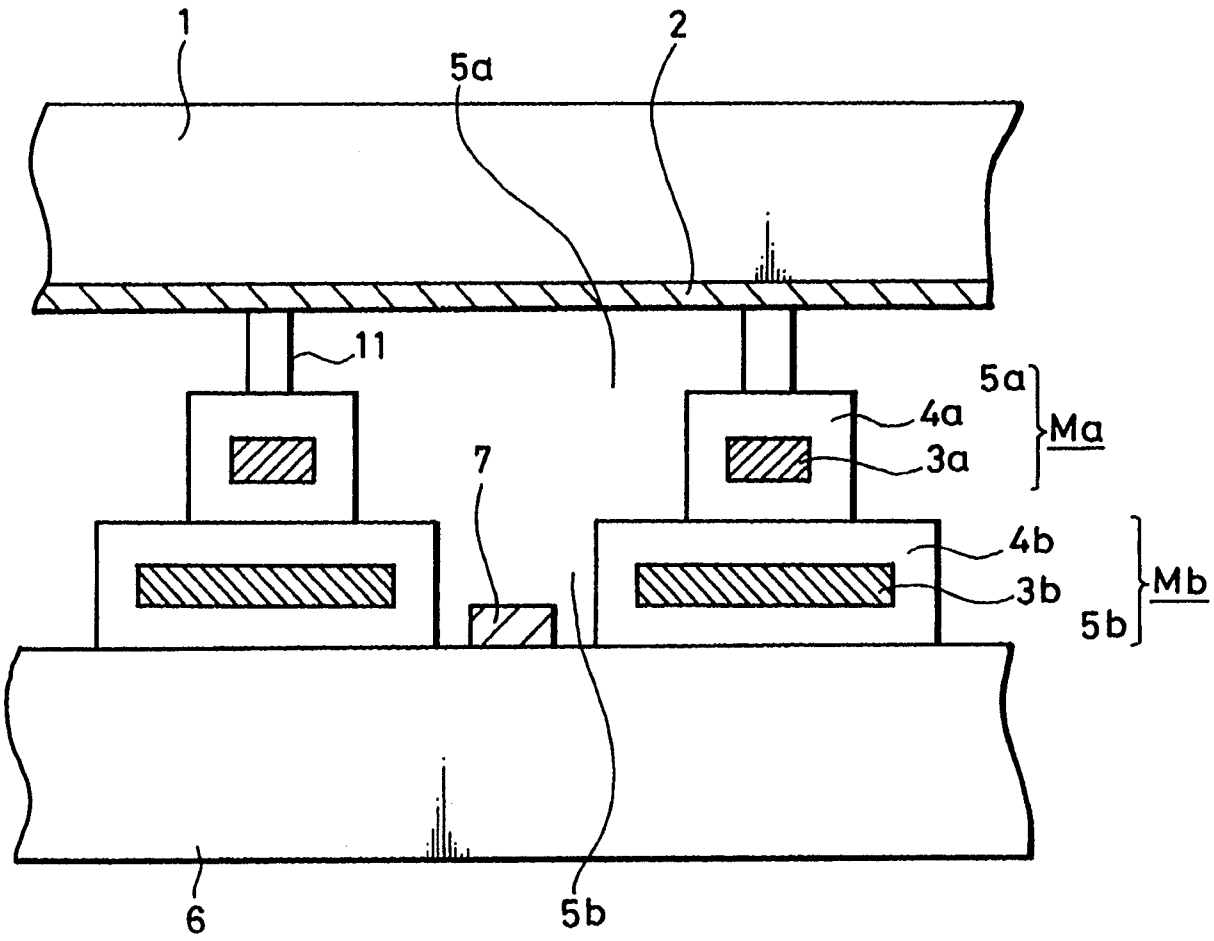
FIG. 13 is a diagrammatic view of a section showing a third embodiment of the present invention.

A third embodiment of the discharge tube for display device will be described with reference to FIG. 13. In accordance with the third embodiment of the present invention, the diameter of the aperture 5*a* in the memory element Ma is made larger than that of the aperture 5*b* in the memory element Mb unlike the second embodiment of FIG. 12.

Figure 14:
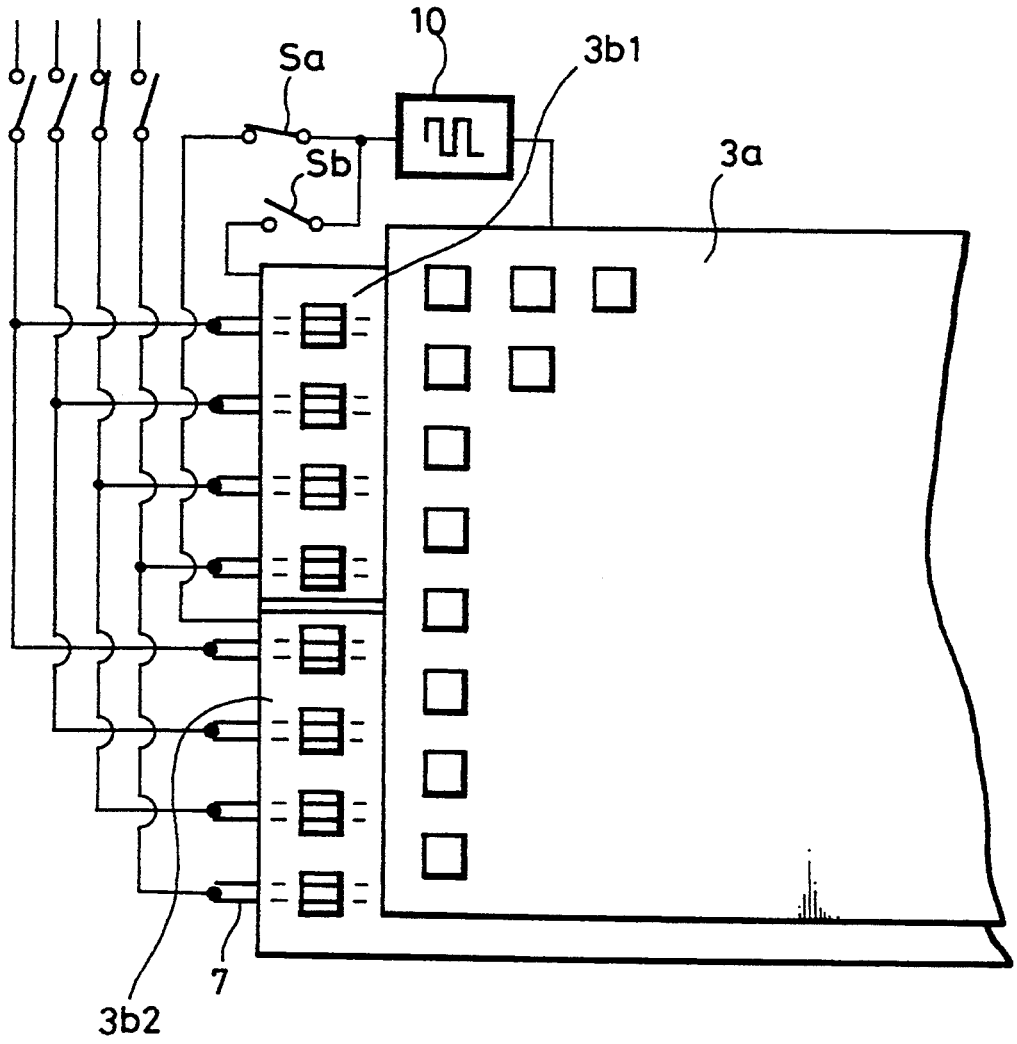
FIG. 14 is a circuit diagram showing a fourth embodiment of the present invention.

A fourth embodiment of the discharge tube for display according to the present invention will be described hereinafter with reference to FIG. 14. The fourth embodiment of the present invention is different from the first embodiment of the discharge tube for display shown in FIGS. 4 to 6 such that as shown in FIG. 14, for example, the rear side memory electrodes 3*b* is separated to provide a plurality of rectangular electrodes 3*b*1, 3*b*2, . . . parallel to a plurality of cathodes 7, the plurality of cathodes 7 are separated into groups in association with a plurality of rectangular electrodes 3*b*1, 3*b*2, . . . and the electrodes of the same position at every group of the plurality of cathodes 7 are connected commonly. As illustrated in FIG. 14, when eight cathodes 7 are separated into two groups, each having four cathodes 7 and the memory electrode 3*b* is separated into two memory electrodes 3*b*1, 3*b*2, it is to be understood that nine connecting wires for the cathodes 7 and the memory electrodes 3*b*1, 3*b*2 are reduced to six connecting wires. A series circuit of the memory power supply 10 and switches Sa, Sb which are connected in parallel to each other and which are alternately turned on and off is connected between the memory electrode 3*a* and the memory electrodes 3*b*1, 3*b*2.

Generally, when n cathodes 7 are separated, the number of the connecting wires of the separated memory electrodes 3*b*1, 3*b*2, . . . and the n cathodes 7 can be reduced to 2 n and therefore the driver circuits can be reduced considerably.

Figure 15:
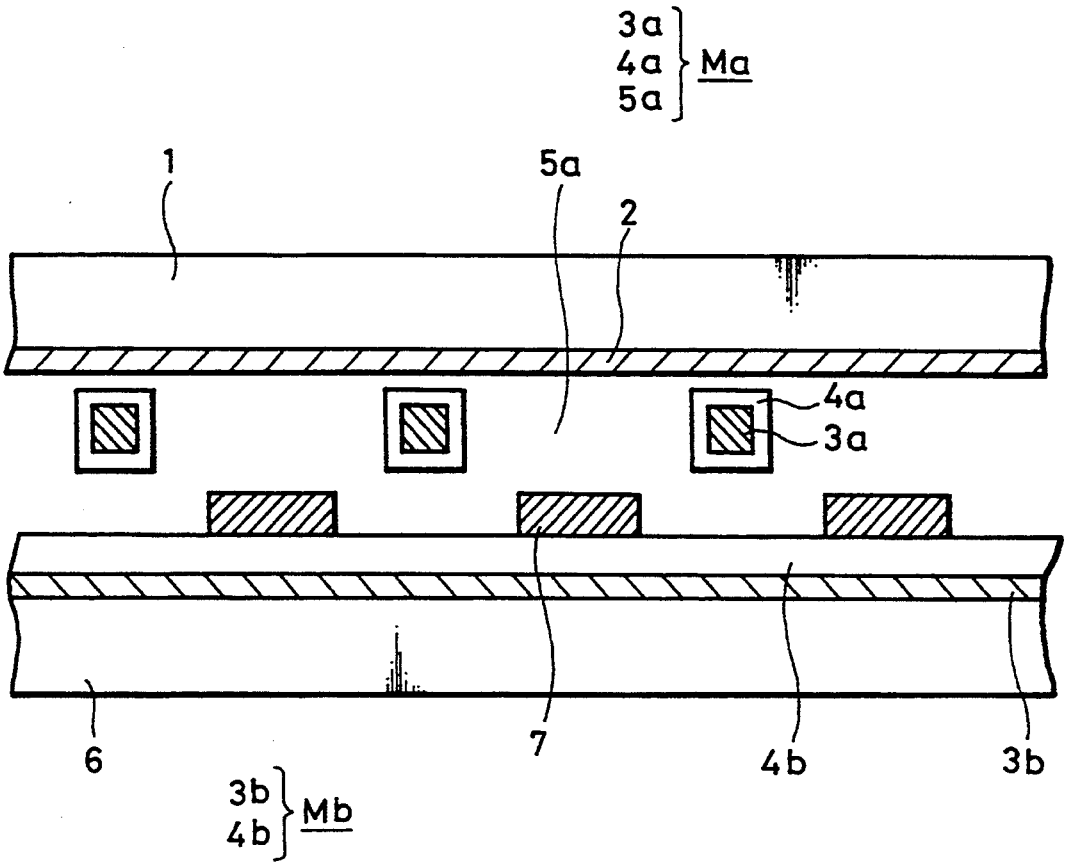
FIG. 15 is a diagrammatic view of a section showing a fifth embodiment of the present invention.

A fifth embodiment of the discharge tube for display according to the present invention will be described with reference to FIG. 15. Operation of the fifth embodiment is similar to that of the first embodiment shown in FIGS. 4 to 6. The front side memory element Ma including the front side memory electrode 3*a* formed of the conductive layer having a plurality of apertures 5*a* arranged in an XY matrix form and in which the entire surface of the front side memory electrode 3*a* is covered with the insulating layer 4*a* and the rear side memory element Mb including the rear side memory electrode 3*b* the whole surface of which is formed of a conductive layer and deposited on the rear surface glass plate 6 and the whole surface of the rear side memory electrode 3*b* is covered with the insulating layer 4*b* are disposed in an opposing relation to each other. A plurality of anodes 2 deposited on the front glass panel 1 in parallel to each other and a plurality of cathodes 7 deposited on the insulating layer 4*b* of the memory element Mb in parallel to one another are disposed so as to cross each other. The front side memory element Ma is disposed between the plurality of anodes 2 and cathodes 7, and a plurality of cathodes 7 are disposed between the front side and rear side memory elements Ma and Mb.

Figure 16:
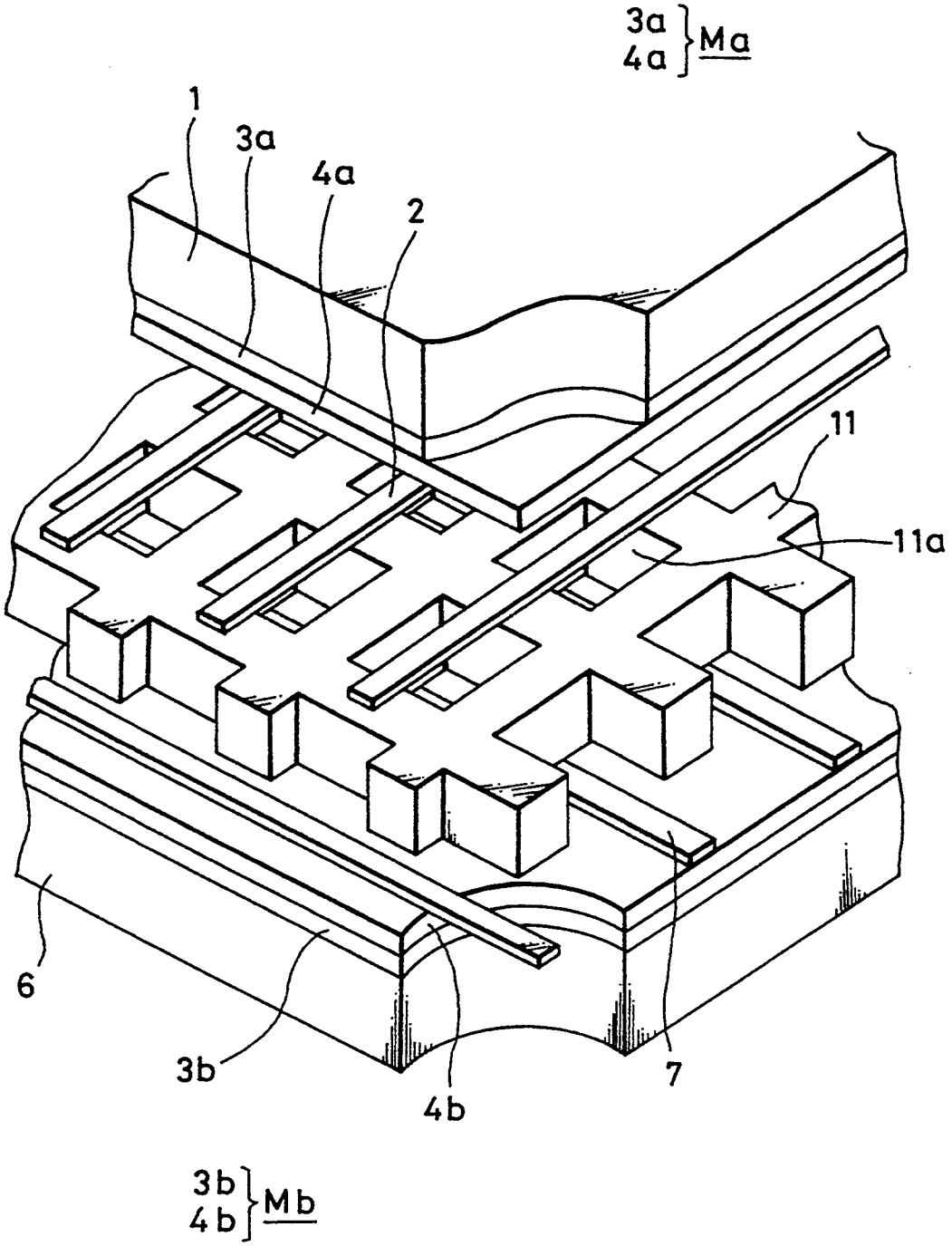
FIG. 16 is an exploded perspective view showing a sixth embodiment of the present invention.
Figure 17:
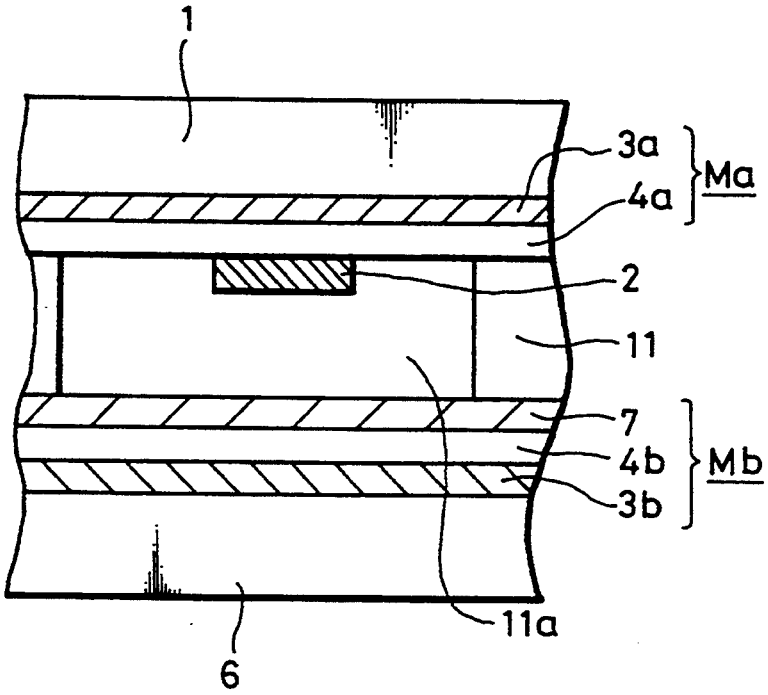
FIG. 17 is a diagrammatic view of a section showing the sixth embodiment of the present invention.

A sixth embodiment of the discharge tube for display according to the present invention will be described below with reference to FIGS. 16 and 17. FIG. 16 is an exploded perspective view of the sixth embodiment and FIG. 17 is a diagrammatic view of a section thereof. As shown in FIGS. 16 and 17, in this discharge tube for display, the following structure is accommodated within the tube body which is formed in such a manner that the peripheral edges of the front and rear glass panels 1 and 6 are sealed by frit glass. The tube body is made vacuous and then a discharging gas such as helium, neon, argon, xenon and so on or mixed gas thereof is sealed into the tube body.

The front side memory element Ma and the rear side memory element Mb are disposed within the tube body in an opposing relation to each other. The front side memory element Ma includes the front side memory electrode 3*a* formed of the transparent whole surface conductive layer and the whole surface of the front side memory electrode 3*a* is covered with the transparent insulating layer 4*a*. The rear side memory element Mb includes the rear side memory electrode 3*b* formed of the whole surface conductive layer. The whole surface of the rear side memory electrode 3*b* is covered with the insulating layer 4*b*. Between the front side and rear side memory elements Ma, Mb, there are disposed a plurality of parallel striped anodes 2 and a plurality of parallel cathodes 7 in such a manner that they are crossed each other across an insulating barrier 11 of a grating configuration having apertures 11*a* of square shape arranged in an XY matrix fashion and corresponding to the crossing points of the anodes 2 and the cathodes 7.

The front side memory electrode 3*a* is formed of a transparent whole surface conductive layer such as an $SnO_2$, ITO or the like. The transparent insulating layer 4*a* is formed by the thick film technique in which the pasted glass powder is printed and baked or by the thin film technique such as the vapor deposition, sputtering method or the like. The surface of the transparent insulting layer 4*a* may be covered with a protecting film such as an Mg0 or the like. The anode 2 is deposited on the insulating layer 4*a* by the printing and baking of metal pastes such as Ag, Au, Al, Ni or the like according to the thick film method or by Cr according to the thin film method, in addition to the transparent conductive layer. It is preferable that a width of the anode 2 is made as narrow as possible in order to generate much more wall electric charges on the insulating layer 4*a* that constructs one portion of the discharge cell of the memory element Ma.

The memory electrode 3*b* is formed on the rear glass panel 6 according to the thick film method or thin film method. It is desirable that the cathode 7 is made of a material which has a low work function and an anti-ion impulse property similarly to the DC-PDP such as Ni, $Lab_6$ or the like. Upon address operation, the cathode 7 is operated at a small current as compared with the ordinary DC-PDP so that the material forming the cathode 7 is not limited thereto and a range in which the material is selected for the cathode 7 can be widened. Also, it is preferable that a width of the cathode 7 is made as narrow as possible similarly to the anode 2 in order to generate much more wall electric charges on the insulating layer 4*b* that constructs one portion of the discharge cell of the memory element Mb.

While the barrier 11 is served as a spacer which is used to hold a proper spacing between the front glass panel 1 and the rear glass panel 6 to seal the discharging gas in the tube body, the shape of the barrier 11 is not limited to the grating and may be a striped one like the DC-PDP. Further, the barrier 11 is not limited to the independent structure and may be formed on the front glass panel 1 or rear glass panel 6 according to the thick film technique.

Figure 18:
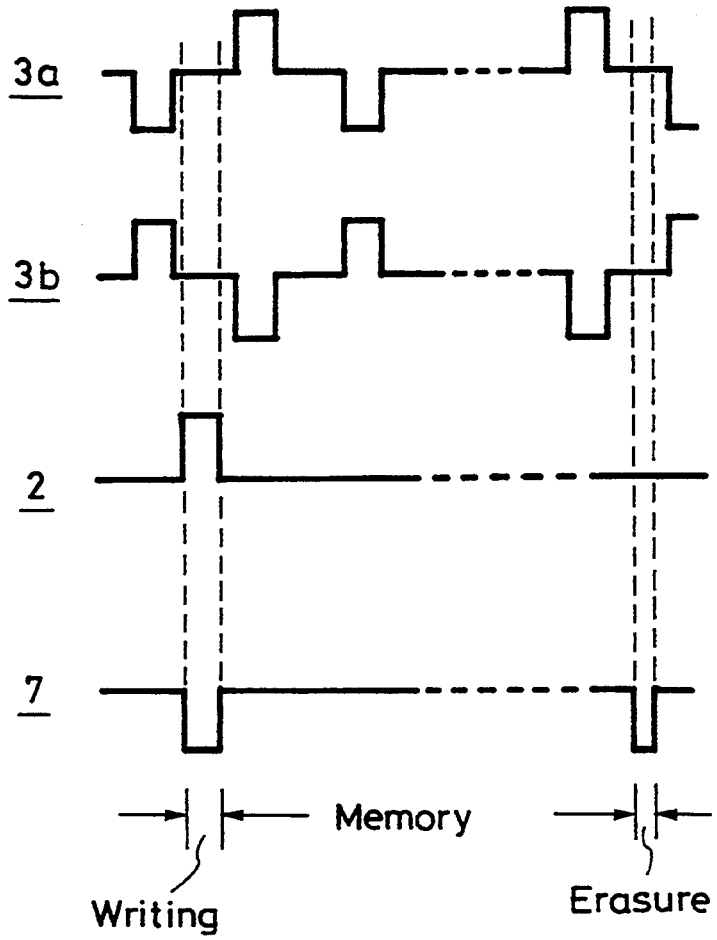
FIG. 18 is a timing chart used to explain operation of the sixth embodiment of the present invention.

Operation of the sixth embodiment of the discharge tube for display according to the present invention will hereinafter be described with reference to FIG. 18. When the discharge is not yet generated within the tube body and the wall electric charge is not yet generated on the insulating layers 4a, 4b of a pair of memory elements Ma, Mb within the aperture 11a of the barrier 11 under the condition such that the AC voltage having an amplitude necessary for maintaining the discharge is applied to a pair of memory electrodes 3a, 3b by the application of pulse voltages of opposite polarities, a voltage of 200 V to 250 V is initially applied to the anodes 2 as shown in FIG. 18. Also, when the cathodes 7 are grounded, a discharging current is flowed between the anode 2 and the cathode 7.

Therefore, as shown in FIG. 18, the wall electric charge is generated on the walls of the insulating layers 4a, 4b within the aperture 11a and the discharge is maintained, thereby the written display content being memorized. At that time, a bias voltage that is prevented from affecting the display is applied to the cathode 7 and a voltage that is prevented from affecting the discharge of the anode in which other signal is written is applied to the anode 2.

In order to stop the maintained discharge or to erase the memory, the erasing pulse of negative polarity is applied to the cathode 7 at the timing at which a negative electric charge is accumulated on the insulating layer 3b of the cathode 7, or when the positive voltage is applied to the memory electrode 3b. By this erasing pulse, the wall electric charge to be accumulated on the inner wall of the aperture 11a can be prevented from being formed so that the discharge is stopped at the next timing, thereby erasing the memory.

When the above discharge tube for display is formed as a discharge tube for color display device, a fluorescent layer is coated on the inside wall of the apertures 11a of the barrier 11 and the fluorescent layer may be made luminous by the ultraviolet rays upon the discharge.

Figure 19:
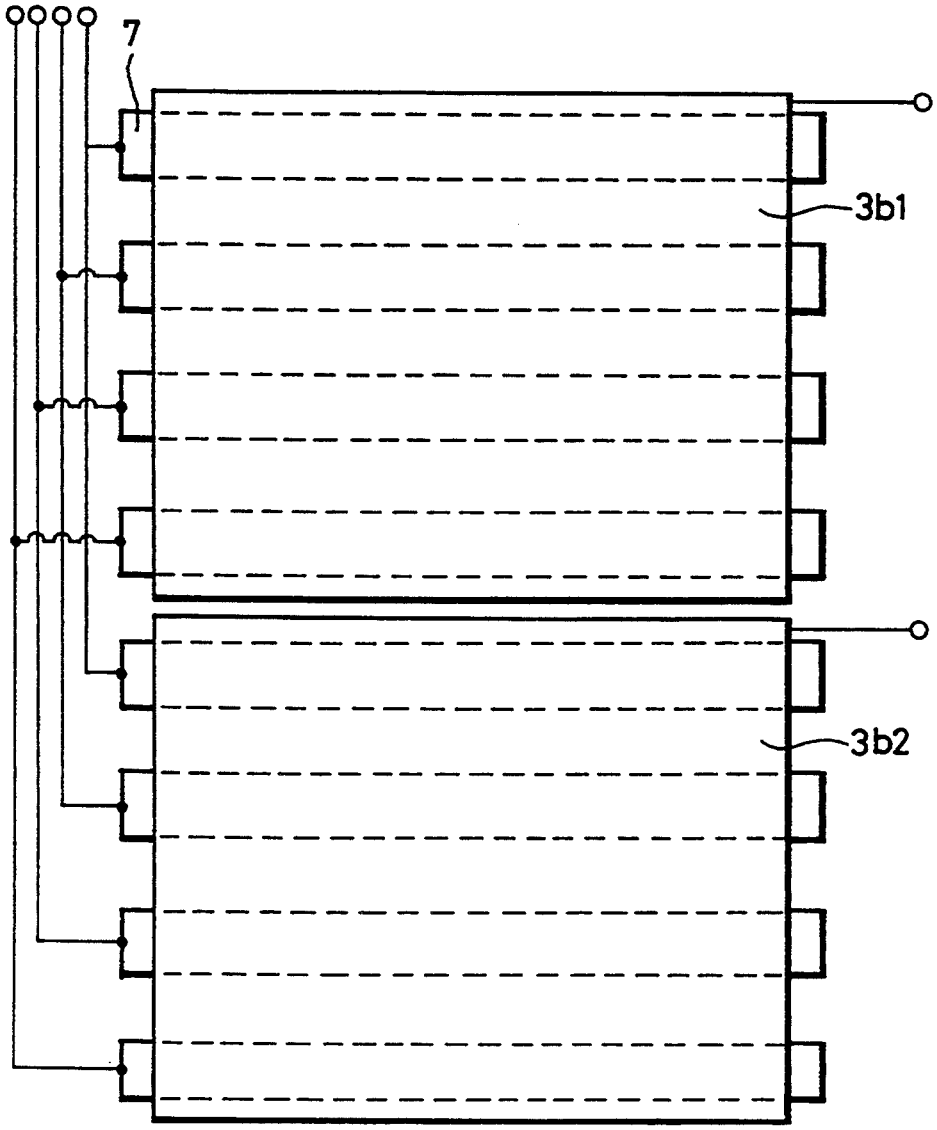
FIG. 19 is a circuit diagram showing a seventh embodiment of the present invention.

A seventh embodiment of the discharge tube for display according to the present invention will be described with reference to FIG. 19. In this embodiment, the rear side memory electrode 3b in the sixth embodiment of FIGS. 16 and 17 is separated to provide a plurality of rectangular electrodes 3b1, 3b2, . . . which are parallel to a plurality of cathodes 7. Then, a plurality of cathodes 7 are separated into groups in association with a plurality of rectangular rear side memory electrodes 3b1, 3b2, . . . and electrodes of a plurality of the thus grouped cathodes 7 are connected commonly at the same positions of every group. When the eight cathodes 7 are separated into the two groups, each having four cathodes and the memory electrode 3b is separated into two memory electrodes 3b1, 3b2 as shown in FIG. 19, it is clear that nine connecting wires for the cathodes 7 and the memory electrodes 3b1, 3b2 can be reduced to six connecting wires.

Generally, when n cathodes 7 are separated, the connecting wires for the separated memory electrodes 3b1, 3b2, . . . and the n cathodes 7 can be reduced to 2 n.

Figure 20:
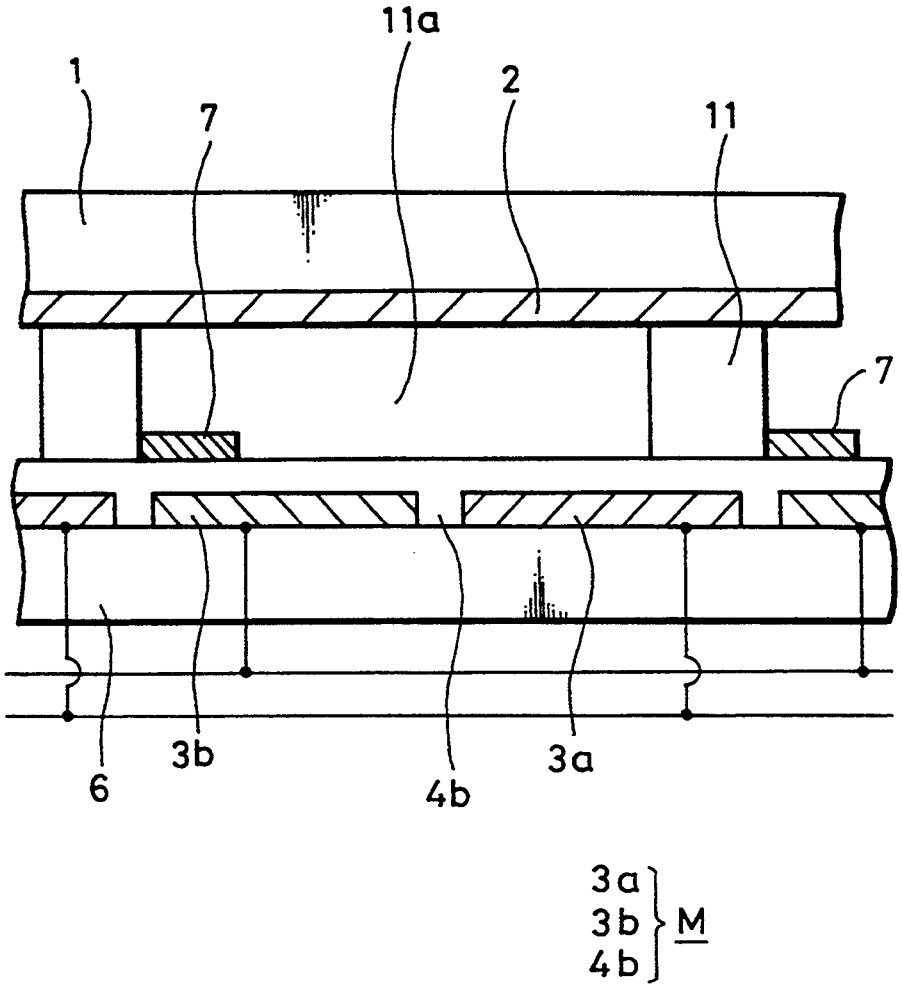
FIG. 20 is a diagrammatic view of a section showing an eighth embodiment of the present invention.

An eighth embodiment of the discharge tube for display according to the present invention will be described with reference to FIG. 20. In this embodiment, as shown in FIG. 20, a rear side memory element M including a plurality of first and second alternate memory electrodes 3a, 3b arranged alternately and in which the whole surfaces of a plurality of first and second memory electrodes 3a, 3b are covered with the insulating layer 4b is formed on the rear glass panel 6. In an opposing relation to the rear side memory element M, a plurality of parallel striped anodes 2 and a plurality of cathodes 7 are crossed each other across the insulating barrier 11 having apertures 11a serving as discharge cells corresponding to respective crossing points between the anodes 2 and the cathodes 7. While a plurality of memory electrodes 3a, 3b are alternately formed on the rear side glass panel 6 in parallel to a plurality of cathodes 7 in this embodiment, the cathodes 7 are commonly connected at each of a plurality of memory electrodes 3a, 3b. Therefore, this discharge tube is operated similarly to the discharge tube in which a plurality of memory electrodes 3a, 3b are disposed in an opposing relation. A plurality of memory electrodes 3a, 3b may be disposed in parallel to a plurality of anodes 2. The apertures 11a of the insulating barrier 11 may be formed as rectangular grooves parallel to a plurality of cathodes 7.

When the discharge tube for display according to this embodiment is formed as a discharge tube for color display, the discharge tube is formed as a surface discharge type in which the fluorescent layer can be coated on the front glass panel 1 side.

While a capacity coupling based on an electrostatic capacity exists on the insulating layer 4a or 4b formed between a plurality of anodes 2 or cathodes 7 and a plurality of memory electrodes 3a or 3b, if a plurality of insulating layers, each having the same width as that of each of a plurality of anodes 2 or cathodes 7 are disposed between a plurality of anodes 2 or cathodes 7 and the insulating layer 4a or 4b, then the capacity can be reduced and therefore a problem caused by the capacity coupling from a driving standpoint can be solved.

According to the first to fourth embodiments of the present invention, since a plurality of anodes and cathodes need not the insulating layer formed on the respective electrodes thereof similarly to those of the conventional DC-PDP and the discharge is produced within the apertures provided on the memory elements, the barrier rib is not needed fundamentally and a driving circuit similar to that of the DC-PDP can be utilized. Therefore, the discharge tube is simple in structure, excellent in mass-production, can be increased in resolution and made large in size with ease. The discharge tube can be driven with ease and a driver circuit thereof can be simplified. In addition, the discharge tube for display can be made inexpensive with ease. Further, according to the third embodiment of the present invention, the driver circuit can be simplified more in structure.

According to the fifth to seventh embodiments of the present invention, although a plurality of anodes and cathodes needs no insulating layer formed on the respective electrodes thereof similarly to the electrodes of the conventional DC-PDP and a memory driving circuit need a relatively large electric power, such memory driving circuit may be provided for only one system. Therefore, the discharge tube for display can be simplified in structure, excellent in mass-production, become high in resolution and made large in size with ease. Further, the driving circuit thereof can be simplified in structure since its driving is simple. In addition, the discharge tube for display can be made inexpensive with ease. Further, according to the sixth embodiment of the present invention, the driving circuit can be more simplified in structure.

Furthermore, according to fifth to seventh embodiments of the present invention, since the discharge spaces of the address discharge and the memory discharge are the same and the positive or negative electric charge is generated on the insulating layer on the memory electrode by the address discharge, the discharge tube can be operated reliably and stably. In addition, since the discharge tube for display has the memory function, the luminous brightness is high. There is then no risk that, even when the number of lines is increased, the brightness will not be lowered thereby.

Having described preferred embodiments of the invention with reference to the accompanying drawings, it is to be understood that the invention is not limited to those precise embodiments and that various changes and modifications thereof could be effected therein by one skilled in the art without departing from the spirit or scope of the novel concepts of the invention as defined in the appended claims.

What is claimed is:

1. A discharge tube for display comprising:

a pair of memory elements, each of said memory elements including a memory electrode formed of a single conductive layer having a plurality of apertures arranged in an XY matrix form and in which the entire surface including the surface defining each of said apertures is covered with an insulating layer, said memory elements being laminated to each other such that corresponding apertures communicate with each other to form an array of discharge cells;

a plurality of first address electrode strips disposed at predetermined intervals parallel to each other on the outer surface of one of said memory elements and a plurality of second electrode strips disposed at predetermined intervals parallel to each other on the outer surface of the other of said memory elements, said first and second address electrodes being arranged so as to cross each other such that their respective crossing points correspond to said respective discharge cells; and a hermetically sealed tubular body containing a discharging gas and in which said first and second address electrodes and said pair of memory elements are contained, wherein when a predetermined voltage is applied between selected ones of the first and second address electrodes a discharge is caused to occur in said discharge cell located at the crossing points of said selected strips and when a predetermined AC voltage is applied between said pair of memory electrodes said discharge is maintained.

2. The discharge tube according to claim 1, wherein the tubular body has a frontal face and said memory electrodes and address electrodes are sequentially arranged therein, the rear memory electrode being divided to provide a plurality of rectangular electrodes parallel to said plurality of second address electrodes, said plurality of second address electrodes being separated into groups, each group associated with one of said plurality of rectangular memory electrodes, and electrodes disposed at the same group being commonly connected.

3. A discharge tube for display comprising:

a front memory element including a front memory electrode having a plurality of apertures arranged in an XY matrix form serving as discharge cells, the entire surface of said front memory electrode being covered with an insulating layer;

a rear memory element formed of a conductive layer, the entire surface of which is covered with an insulating layer, said front memory element and said rear memory element being disposed in an opposing relation;

a plurality of parallel striped first and second address electrodes being disposed respectively at predetermined intervals so that said first and second electrodes cross each other, said front memory element being disposed between said first and second address electrodes such that the respective crossing points of said address electrodes correspond to respective discharge cells; and a hermetically sealed tubular body containing a discharging gas and into which said plurality of second address electrodes are sealed such that they are disposed between said front and rear memory elements, wherein when a predetermined voltage is applied between selected ones of the first and second address electrodes, a discharge is caused to occur in said discharge cell located at the crossing point of said first and second address electrodes, and when a predetermined AC voltage is applied between said front and rear memory electrodes, said discharge is thereby maintained.

4. A discharge tube for display comprising:

a front memory element including a front memory electrode formed of a transparent conductive layer, the entire surface of said front memory electrode being covered with a transparent insulating layer;

a rear memory element including a rear memory electrode formed of a conductive layer, the entire surface of said rear memory electrode being covered with an insulating layer, said front memory element and said rear memory element being disposed in an opposing relation;

a plurality of parallel striped first and second address electrodes disposed between said front and rear memory elements so that said first and second electrodes cross each other;

an insulating barrier having a plurality of apertures serving as discharging cells corresponding to the respective crossing points of said first and second address electrodes disposed between said first and second electrodes; and a hermetically sealed tubular body containing a discharging gas and into which said memory elements, said address electrodes and said insulating barrier are sealed, wherein when a predetermined voltage is applied between selected ones of the first and second address electrodes, a discharge is caused to occur in said discharge cell located at the crossing point of said first and second address electrodes, and when a predetermined AC voltage is applied between said pair of memory electrodes, said discharge is maintained.

5. The discharge tube for display according to claim 4, wherein said rear memory electrode is separated to provide a plurality of groups of rectangular electrodes parallel to the second address electrodes, said plurality of second address electrodes being separated into groups in association with said separated rear memory electrodes and the grouped electrodes disposed in association with the grouped electrodes are commonly connected.

6. A discharge tube for display comprising:

a rear memory element including a plurality of first and second memory electrodes arranged alternately with respect to each, the entire surface of each of said first and second memory electrodes being covered with an insulating layer;

a plurality of parallel striped first and second address electrodes disposed on opposite sides of said rear memory element so as to cross each other;

an insulating barrier having a plurality of apertures serving as discharge cells corresponding to respective crossing points of said first and second address electrodes disposed between said first and second memory electrodes; and a hermetically sealed body containing a discharging gas and into which said rear memory element, said address electrodes and said insulating barrier are sealed, wherein when a predetermined voltage is applied between selected ones of the first and second address electrodes, a discharge is caused to occur in the discharge cell located at the crossing point of said first and second address electrodes, and when a predetermined AC voltage is applied between said plurality of first and second of memory electrodes, said discharge is maintained.

7. A discharge tube for display comprising an assembly of first and second memory elements, each element being formed of a conductive layer having a plurality of apertures arranged in an XY matrix, the surfaces of said conductive layer being covered by an insulating layer, said first and second memory elements being positioned one over the other such that the apertures in one layer are in register with the aperture in the other layer to form a common matrix of discharge cells; and a plurality of first address electrode strips uniformly disposed on the outer surface of the first memory element in parallel spaced arrangement and a plurality of second address electrode strips uniformly disposed on the outer surface of the second memory element in parallel spaced arrangement, the first electrode strips extending transversely to the second electrode strips to form a plurality of crossing points corresponding to the discharge cells, said assembly being hermetically sealed in a tubular body in which a discharging gas is housed;

means for applying to selected ones of said first address electrode strips and to selected ones of said second address electrode strips, respectively, a voltage to cause the gas discharge to occur in the discharge cell located at the crossing point of said selected address electrodes; and means for applying an AC voltage to the conductive layers of each of said memory electrodes to thereby maintain said gas discharge.

* * * * *